US005283084A

United States Patent [19]

Lau

[11] Patent Number: 5,283,084

[45] Date of Patent: Feb. 1, 1994

[54] PROCESS FOR MAKING WRINKLE-FREE COATING USING SOLVENTBORNE CLEARCOAT COMPOSITION OVER WATERBORNE BASECOAT COMPOSITION

[75] Inventor: David K. K. Lau, Royal Oak, Mich.

[73] Assignee: BASF Corporation, Southfield, Mich.

[21] Appl. No.: 880,964

[22] Filed: May 8, 1992

[51] Int. Cl.[5] ..... B05D 1/36

[52] U.S. Cl. ..... 427/407.1; 427/409; 427/412.1

[58] Field of Search ..... 427/407.1, 409, 412.1

[56] References Cited

U.S. PATENT DOCUMENTS 3,953,643 4/1976 Cheung et al. ..... 428/220
4,403,003 9/1983 Backhouse ..... 427/407.1
4,971,841 11/1990 Panush et al. ..... 427/407.1
5,102,692 4/1992 Tanigami et al. ..... 427/142

*Primary Examiner*—Asok Pal
*Assistant Examiner*—P. Achutamurthy
*Attorney, Agent, or Firm*—Paul L. Marshall

[57] ABSTRACT

The presence of an acid catalyst in a clearcoat composition enables the production of a wrinkle-free coating in a process comprising the simultaneous curing of applied layers of both a waterborne basecoat composition as well as a solventborne clearcoat composition. The waterborne basecoat composition comprises an organic resin, a crosslinker, and a free amine. The solventborne clearcoat composition comprises an acid catalyst in an amount significantly higher than the quantity normally used in high solids original equipment manufacturer clearcoat compositions, a polymer which is crosslinkable with melamine, and a monomeric melamine type crosslinking resin for crosslinking the polymer. The process is most preferably used to make an automotive quality topcoat.

24 Claims, No Drawings

PROCESS FOR MAKING WRINKLE-FREE COATING USING SOLVENTBORNE CLEARCOAT COMPOSITION OVER WATERBORNE BASECOAT COMPOSITION

BACKGROUND OF THE INVENTION

1. Field of the Invention

The present invention relates to processes for coating substrates with a solventborne clearcoat composition over a waterborne basecoat composition.

2. Discussion of Background Material

In prior art processes for making coated objects, particularly automotive coatings, manufacturers have utilized coating systems which involve the use of both basecoats and clearcoats. Traditionally, both the basecoats and clearcoats were applied as solventborne compositions. However, more recently manufacturers have become increasingly concerned about environmental impact due to the emission of organic solvents into the atmosphere during the application and curing of solventborne coating compositions. As a result of this concern and environmental regulations associated therewith, it is becoming increasingly desirable to utilize waterborne coating compositions.

It has been found that if a waterborne basecoat composition containing free amine is applied to a substrate, followed by the application of a traditional solventborne clearcoat composition comprising a monomeric melamine as a crosslinking resin, upon simultaneous curing of both layers, the resulting cured film appears "wrinkled". This appearance is undesirable and lacks commercial value. It has been found that clearcoat compositions utilizing polymeric melamine do not exhibit this wrinkling problem. As a result, the current commercially available clearcoat compositions utilize polymeric melamine as the crosslinking entity, as opposed to monomeric melamine. However, the use of monomeric melamine could permit formulating a higher solids composition and could result in improved physical properties of the resulting coating, if only the wrinkling problem could be solved.

The inventor of the present invention has unexpectedly discovered that the above described advantages of high solids concentration and improved physical properties can be achieved by utilizing a solventborne monomeric melamine clearcoat composition which comprises a high level of acid catalyst. Such a composition has been unexpectedly found to achieve the advantages of improved physical film properties as well as increased solids content in the clearcoat composition, while avoiding entirely the wrinkling problem described above.

However, compositions comprising a "high level of acid catalyst", in combination with monomeric melamine, are not new. Such compositions have previously been utilized in the "refinish" industry, i.e. in the repainting of automotive body panels after damage to the finish. However, such repair processes do not utilize waterborne basecoat compositions in combination with the high level of acid catalyst, monomeric melamine-containing clearcoat compositions. That is, such use of a high level of acid catalyst in monomeric melamine compositions has traditionally been limited to use in conjunction with solventborne basecoats. Furthermore, such repair processes are carried out at low temperature (i.e. temperatures of from about 160° F. to about 210° F.).

In contrast, the process of the present invention utilizes a high level of acid catalyst in a monomeric melamine composition applied over a layer of an uncured waterborne basecoat, not to mention use over a waterborne basecoat which further comprise a free amine.

In the art of producing automotive topcoats, it is desirable to utilize less organic solvent in coating compositions which are "organic solvent based". Organic solvents serve to disperse (and dissolve) polymers, oligomers, monomers, and other organic components in the composition, in order that the viscosity of the mixture is low enough that the dispersion can be sprayed, etc. However, the presence of organic solvents in the coating composition ultimately results in the release of the organic solvent into the atmosphere, because the solvent is released in a curing step carried out at elevated temperatures. One way of reducing the amount of organic solvent released into the atmosphere is to utilize low viscosity components in the mixture, so that less organic solvent is needed to achieve the desired viscosity. One example of such a low viscosity crosslinking agent is monomeric melamine.

As was described above, the use of monomeric melamine as a crosslinking agent has been found to be unsatisfactory in the event that it is present in a solventborne clearcoat composition which is applied over a waterborne basecoat composition comprising an amine, followed by simultaneous curing of both the resulting uncured waterborne basecoat layer, as well as the uncured solventborne clearcoat layer coating composition (for the clearcoat). The result is a cured coating which exhibits a most unsatisfactory "wrinkled" appearance. Such wrinkled coatings have no substantial commercial value.

However, the present invention provides a process by which an uncured layer of a solventborne clearcoat composition comprising a monomeric melamine can be applied directly over an uncured layer of a waterborne basecoat composition comprising an amine, with both of the layers thereafter being simultaneously cured, to produce a substantially wrinkle-free, cured coating. A first advantage of this process is that less organic solvent need be used (hence less organic solvent is released into the environment). A second advantage of this process is that a higher concentration of solids can be present in the solventborne clearcoat composition, which reduces the volume of composition required. A third advantage of this process is that the resulting cured coating exhibits improved physical properties.

The process of the present invention produces the above-described advantages through the use of a relatively high concentration of an acid catalyst in the solventborne clearcoat composition. This high level of acid catalyst ensures an adequate degree of catalysis for the crosslinking of the organic polymer in the clearcoat composition. That is, the high level of the acid catalyst ensures adequate crosslinking during the curing step, regardless of the presence of the free amine, which has a retarding effect upon the crosslinking of the organic polymer. Thus the acid catalyst is present in a quantity sufficient to both: (1) provide the necessary catalysis for the crosslinking reaction required for the curing of the clearcoat composition, and (2) prevent an undesired retardation of the crosslinking of the clearcoat composition.

SUMMARY OF THE INVENTION

The present invention pertains to a process for producing a wrinkle-free coating. A first step in the process comprises applying a waterborne basecoat composition to a substrate so that an uncured basecoat layer is formed on the substrate. A second step in the process comprises applying a substantially transparent, one-component solventborne clearcoat composition over the first uncured layer of a waterborne basecoat composition, so that an uncured solventborne clearcoat layer is formed over the uncured waterborne basecoat layer. A third step in the process comprises simultaneously curing both the uncured waterborne basecoat layer and the uncured solventborne clearcoat layer.

The waterborne basecoat composition comprises water, an organic resin, a crosslinker, and a free amine. The solventborne clearcoat composition comprises an acid catalyst, a monomeric melamine crosslinking resin, and a polymer which is crosslinkable with a monomeric melamine.

During the simultaneous curing of both the uncured waterborne basecoat layer as well as the uncured solventborne clearcoat layer, the following components are crosslinked:

(1) the organic resin of the waterborne basecoat composition,
(2) the crosslinking resin of the solventborne clearcoat composition, and
(3) the crosslinkable polymer of the solventborne clearcoat composition, resulting in the production of a cured coating.

The selection of the particular acid catalyst(s) present in the solventborne coating composition, as well as the selection of the amount of the acid catalyst(s) present in the solventborne coating composition, is performed so that a wrinkle-free coating is produced.

It is an object of the present invention to produce a cured polymeric coating on a substrate.

It is a further object of the present invention to produce a coating on a substrate wherein the coating is substantially wrinkle-free.

It is a further object of the present invention to produce an automotive quality coating on substrate suited for use as an automotive body panel.

It is a further object of the present invention to produce an automotive quality coating on a substrate wherein the coating is comprised of both a basecoat layer and a clearcoat layer.

It is a further object of the present invention to produce coating on a substrate, wherein the coating comprises a metallic flake pigment.

It is a further object of the present invention to produce a coating through the use of a waterborne coating composition comprising an amine.

It is a further object of the present invention to produce a coating through the use of a solventborne coating composition comprising a monomeric melamine.

It is a further object of the present invention to produce a substantially wrinkle-free coating with a process which utilizes a waterborne basecoat composition and a solventborne clearcoat composition, in which the basecoat composition comprises a free amine and the clearcoat composition comprises monomeric melamine and a high level of acid catalyst.

It is a further object of the present invention to enable the production of a wrinkle-free coating by applying a solvent-borne coating composition, comprising a monomeric melamine crosslinking agent, over a waterborne coating composition, comprising an amine, followed by simultaneously curing both compositions.

DETAILED DESCRIPTION OF THE PREFERRED EMBODIMENTS

In general, any substrate material may be coated according to the process of the present invention. Substrates such as metal, plastic, glass, ceramic, paper, wood, as well as other materials, may be utilized in the process of the present invention. The particular drying and/or curing requirements may vary for different kinds of substrates. However, the process of the present invention is particularly adapted for metal substrates, more specifically as a process for producing an automotive paint finish. The substrate may be a bare metal substrate, or may be primed to impart corrosion resistance and/or increased adherence for subsequent coating layers. Such metal substrates as steel, aluminum, copper, magnesium, and alloys thereof, among other metals, may be used for making a metal substrate.

As used herein, the phrase "organic resin" is used with respect to one or more crosslinkable polymeric compounds present in the waterborne basecoat composition. Furthermore, the phrases "polymer which is crosslinkable with melamine" and "crosslinkable polymer" are used with reference to the one or more crosslinkable polymeric compounds present in the solventborne clearcoat composition. The phrase "crosslinking resin" is used with reference to the one or more compounds present in the solventborne clearcoat composition which react to crosslink the crosslinkable polymer which is present in the solventborne clearcoat formulation.

As used herein, the term "basecoat" refers to a coating layer which is positioned over a bare substrate or over a substrate which has a primer coating thereon. More importantly, the basecoat is positioned under a clearcoat. The term "topcoat" refers to the sum of the basecoat and the clearcoat. Preferably the substrate is metal and preferably the substrate has been primed so that the basecoat has good adhesion thereto.

As a general rule, the basecoat is the primary layer which is responsible for the coloration of the substrate. The basecoat is preferably opaque, so that the primer layer (or bare metal) is not visible therethrough, and also so that the primer layer is not exposed to ultraviolet radiation. Preferably the basecoat comprises pigment particles which impart color and opacity to the basecoat. The pigment particles can be organic pigments as well as metallic pigments. The metallic pigments can comprise metallic flake pigments, which impart a metallic appearance to the coated substrate. Any pigments which are commonly recognized as useful in the coating arts can be used in the process of the present invention.

As used herein, the term "clearcoat" refers to a coating layer which is positioned over the basecoat. Furthermore, the clearcoat is generally the outermost coating over the substrate. Thus the outer surface of the clearcoat is directly exposed to the environment.

As a general rule, the clearcoat is substantially transparent, whereby the basecoat is visible through the clearcoat. However, the clearcoat may comprise pigments, dyes, etc, in order to obtain coloration effects in combination with the basecoat. Even if the clearcoat comprises pigments, the clearcoat is still considered to be substantially transparent if the pigments are transparent pigments. However, generally the clearcoat is not colored and is thus substantially transparent as well as substantially colorless. The clearcoat is preferably comprised primarily of a polymer network (i.e. a crosslinked polymer) which is highly resistant to environmental degradation from ultraviolet light, water, high and low temperature extremes, dust and dirt, etc.

The phrase "solventborne clearcoat composition" refers to a substantially liquid composition (i.e. a suspension or solution of a polymer, together with other ingredients in an organic solvent) which, in the process of the present invention, is to be applied over an uncured layer of the basecoat composition, and which, when cured, forms the clearcoat.

The process of the present invention comprises making a waterborne basecoat composition. The phrase "waterborne basecoat composition" refers to a composition which is a suspension or solution of an organic resin, as well as other ingredients, in water. The waterborne basecoat composition is applied to the substrate and is thereafter cured to form the basecoat. Water serves as a carrier, vehicle, or solvent for the organic resin. Preferably the resin is dispersed in the water phase so that a resin in water dispersion is present. However, it is possible to utilize an organic resin which is water soluble, in which event a solution of resin in water is present.

In general, the waterborne basecoat composition may be any aqueous coating composition which comprises a free amine and an organic resin. However, preferably the basecoat composition comprises an organic resin which may be any suitable film-forming anionic resin conventionally used in the art of coatings, wherein the resin has carboxylic groups thereon, e.g. a polyurethane resin, an acrylic resin, a polyester, etc., and mixtures thereof. Polyurethanes, acrylics and polyesters require the presence of a free amine in order to obtain a water dispersion of the resin suitable for a coating composition. Polyurethane resins and acrylic resins are the preferred organic resins for use with the process of the present invention. Most preferably the organic resin is a polyurethane resin.

In general, the organic resin is present in the waterborne basecoat composition in an amount of from about 10 weight percent to about 70 weight percent, based on the weight of the entire waterborne basecoat composition. Preferably the organic resin is present in the waterborne basecoat composition in an amount of from about 12 weight percent to about 25 weight percent, based on the weight of the waterborne basecoat composition. Most preferably the organic resin is present in the waterborne basecoat composition in an amount of about 20 weight percent, based on the weight of the waterborne basecoat composition.

If an acrylic resin is utilized in the basecoat composition, it may be either a thermosetting acrylic resin or a thermoplastic acrylic resin. Acrylic lacquers, such as are described in U.S. Pat. No. 2,860,110 (which is herein incorporated by reference), are one type of film forming composition useful in the process of the present invention. Acrylic lacquer compositions typically comprise homopolymers of methyl methacrylate and copolymers of methyl methacrylate which contain among others, acrylic acid, methacrylic acid, alkyl esters of acrylic acid, alkyl esters of methacrylic acid, vinyl acetate, acrylonitrile, styrene and the like.

If an acrylic lacquer is used as a component of the basecoat composition, it is preferred that the relative viscosity of the acrylic lacquer polymer is from about 1.05 (units) to about 1.4 (units). If the relative viscosity of the acrylic lacquer polymer is substantially below 1.05 (units), the resulting films exhibit relatively poor solvent resistance, durability, mechanical properties. On the other hand, when the relative viscosity is increased substantially above 1.40 (units), paints made from these resins are difficult to spray and have high coalescing temperatures.

Another type of film-forming material useful in the process of the present invention is a combination of a cross-linking agent and a carboxy-hydroxy acrylic copolymer. Monomers that can be copolymerized in the carboxy-hydroxy acrylic copolymer include esters of acrylic and methacrylic acid with alkanols containing 1 to 12 carbon atoms, such as ethyl acrylate, methyl methacrylate, butyl acrylate, butyl methacrylate, 2-ethylhexyl methacrylate, lauryl methacrylate, benzyl acrylate, cyclohexyl methacrylate, and the like. Additional monomers are acrylonitrile, methacrylonitrile, styrene, vinyl toluene, alpha-methyl styrene, vinyl acetate, and so forth. These monomers contain one polymerizable ethylenically unsaturated group and are devoid of hydroxyl and carboxylic groups.

The cross-linking agents used in combination with the hydroxy-carboxy copolymers are those compositions which are reactive with hydroxy groups and/or carboxylic acid groups. Examples of such cross-linking agents are polyisocyanates (typically di- and/or triisocyanates), polyepoxides, and aminoplast resins. Particularly preferred cross-linking agents are the aminoplast resins.

The polyisocyanates, when reacted with hydroxyl bearing polyester or polyether or acrylic polymers, yield urethane films useful in the process of this invention in both the basecoat and the topcoat. The isocyanate (—NCO)—hydroxyl (—OH) reaction takes place readily at room temperature, so that ambient and low temperature cure is possible.

The waterborne basecoat composition used in the process of the present invention further comprises a free amine in addition to the organic resin. In general, the free amine is an anionic amine because it must substantially neutralize the cationic carboxylic groups on the anionic resin, in order to assist in dispersing the resin in water. Preferably, the free amine comprises at least one member selected from the group consisting of an alkylamine, an alkanolamine, and ammonia. More preferably, the free amine comprises at least one member selected from the group consisting of a triethylamine and a dimethyl ethanol amine. Most preferably the free amine is a dimethyl ethanol amine.

In general, the free amine is present in the waterborne basecoat composition in an amount of from about 0.1 weight percent to about 1.5 weight percent based on the weight of the basecoat composition. Preferably the free amine is present in the waterborne basecoat composition in an amount of from about 0.3 weight percent to about 0.7 weight percent. Most preferably the free amine is present in the waterborne basecoat in an amount of about 0.4 weight percent.

The waterborne basecoat composition further comprises a crosslinker. In general, the crosslinker may be any resin which is capable of crosslinking the resin in the basecoat formulation. Preferably the crosslinker comprises at least one member selected from the group consisting of an aminoplast resin and an isocyanate resin. Still more preferably the crosslinker comprises an aminoplast resin. Most preferably the crosslinker is Cymel® 327 brand aminoplast resin obtained from American Cyanamid of Norwalk, Conn. Another preferred crosslinker is Resimene® 747 brand aminoplast resin, produced by Monsanto Company of Springfield, Mass.

In general, the crosslinker is present in the waterborne basecoat composition in an amount of from about 3 weight percent to about 12 weight percent, based on the weight of the basecoat composition. Preferably, the crosslinker is present in an amount of from about 3 weight percent to about 10 weight percent, and most preferably from about 3 weight percent to about 6 weight percent.

In the process of the present invention, the waterborne basecoat comprises a free amine in order to neutralize the carboxylic acid groups present on the organic resin. This neutralization assists in dispersing the resin in water. In general the free amine may be any amine which assists in dispersing the resin in water. In general, the free amine is present in the waterborne basecoat composition in an amount which is sufficient to aid dispersing the resin in the water.

The migration of the free amine from the waterborne basecoat into the clearcoat inhibits and/or postpones the crosslinking process until the amine is evaporated. The crosslinking process occurs at an elevated temperature (i.e. 240° F. to 300° F.) for a specified period of time (15 to 40 minutes for most automotive assembly plant operations). The delayed curing of the clearcoat causes a wrinkled appearance, probably as a result of a significant difference in the cure rate between the clearcoat and the basecoat. Another possible cause of the wrinkling problem can be that the amount of amine which migrates into the clearcoat composition varies depending upon the region. Such regional variations could cause some areas to crosslink slower than other regions.

The process of the present invention solves the wrinkling problem by providing an excess of acid catalyst (in the solventborne clearcoat composition) to overcome the effect of the free amine, which otherwise would cause the above mentioned problem.

The solventborne clearcoat composition comprises at least one organic solvent, and preferably comprises a mixture of at least two organic solvents. In general, the organic solvent comprises any commonly used organic solvent (or mixture thereof) in which the acid catalyst, the crosslinking resin, and the crosslinkable polymer dissolve (or disperse) to a degree that the resulting solution or dispersion can be applied in order to form a coating. Preferably the organic solvent comprises at least one member selected from the group consisting of toluene, xylene, blends of aromatic solvents, and methanol. A useful, and preferable organic solvent is a blend of: 32 weight percent xylene, 32 weight percent Hi-Sol® 10, 13 weight percent butanol, 22 weight percent methanol, 6 weight percent ethylhexanol, and 5 weight percent primary amyl acetate. The organic solvent or solvents are selected for optimum application and characteristics, and to achieve a good appearance. Important considerations comprise viscosity, sprability, sag tolerance, smoothness, and gloss (i.e. distinctness of image).

The organic solvent should be present in an amount effective to produce a solution or suspension which can be applied to produce an automotive quality coating on a substrate. Preferably, the organic solvent is present in an amount of from about 30 weight percent to about 60 weight percent, based on the weight of the solventborne clearcoat composition. Most preferably the organic solvent is present in an amount of about 45 weight percent.

The solventborne clearcoat composition further comprises a crosslinkable polymer which has hydroxy groups thereon and is crosslinkable with melamine. Preferably the crosslinkable polymer is at least one member selected from the group consisting of an acrylic polymer, an alkyd polymer, a polyurethane, and a polyester. Still more preferably the crosslinkable polymer is at least one member selected from the group consisting of an acrylic polymer, a polyurethane, and a polyester. Most preferably the crosslinkable polymer is an acrylic resin.

Preferably the crosslinkable polymer is present in the clearcoat composition in an amount of from about 10 weight percent to about 60 weight percent, based on the weight of the entire solventborne clearcoat composition. Still more preferably the crosslinkable polymer is present in the clearcoat composition in an amount of from about 30 weight percent to about 45 weight percent, based on the weight of the solventborne clearcoat composition. Most preferably the crosslinkable polymer is present in the clearcoat composition in an amount of about 38 weight percent, based on the weight of the solventborne clearcoat composition.

The crosslinking resin present in the solventborne clearcoat composition comprises a monomeric melamine resin. Preferably the crosslinking resin comprises at least one member selected from the group consisting of the series of Resimene brand aminoplast resins and the series of Cymel® brand aminoplast resins, wherein the resin (or resins) has a percent weight solids of from about 80 weight percent to about 100 weight percent. These aminoplast resins are manufactured by Monsanto Company and American Cyanamid Corporation, respectively. Most preferably the crosslinking resin is Resimene® 755 brand resin.

In general, the crosslinking resin is present in the solventborne clearcoat composition in an amount sufficient to crosslink the crosslinkable polymer to the desired degree. Preferably the crosslinking resin is present in the solventborne clearcoat composition in an amount of from about 12 weight percent to about 22 weight percent, based on the weight of the entire solventborne clearcoat composition. More preferably, the crosslinking resin is present in the solventborne clearcoat composition in an amount of from about 15 weight percent to about 20 weight percent, based on the weight of the entire solventborne clearcoat composition. Most preferably, the crosslinking resin is present in the solventborne clearcoat composition in an amount of about 18 weight percent, based on the weight of the solventborne clearcoat composition.

The solventborne clearcoat composition further comprises an acid catalyst. The catalyst type and quantity are carefully selected to give the optimum desired properties of the finished coating, in order to avoid severe film wrinkling and poor appearance. The normal catalyst quantity used in automotive original equipment manufacturers' coatings varies from 0.2% to 2%, based on the weight of the solventborne composition. The catalyst quantity necessary to overcome the migrated amine (described above) depends on the catalyst types. In general, two to three times the catalyst quantity present in prior original equipment manufactured coating formulations is required, in order to prevent the problem of producing a wrinkled coating.

In general, the acid catalyst can be any chemical species which catalyzes the curing of monomeric melamine. Preferably, the acid catalyst comprises at least one member selected from the group consisting of an acid anhydride, an acid phosphate, a mono or disulfonic acid, an alkoxyacid, and any other acid catalyst suitable for the curing of monomeric melamine. Preferably, the acid catalyst comprises at least one member selected from the group consisting of a paratoluene sulfonic acid, a dodecylbenzene sulfonic acid, a dinonylnaphthalene disulfonic acid, a phenyl acid phosphate, and a phenyl phosphonous acid. Most preferably the acid catalyst comprises at least one member selected from the group consisting of a phenyl acid phosphate or a phenyl phosphonous acid.

In general, during the process of the present invention, the acid catalyst is present in the solventborne clearcoat composition in an amount sufficient to allow the production of a wrinkle-free coating if monomeric melamine is used as the crosslinking resin. Preferably the acid catalyst is present in the solventborne clearcoat composition in an amount of from about 1 weight percent to about 5 weight percent based on the weight of solids in the solventborne clearcoat composition. Still more preferably, the acid catalyst is present in the solventborne clearcoat composition in an amount of from about 1.5 weight percent to about 5 weight percent, depending upon the particular catalyst selected. Most preferably, the acid catalyst is present in the solventborne clearcoat composition in an amount of from about 2 to about 4 weight percent, depending upon the particular catalyst selected.

The selection of the particular acid catalyst (or group of acid catalysts), as well as the amount of the acid catalyst, must be performed so that a substantially wrinkle-free coating is produced. The selection of a combination of acid catalyst type and acid catalyst amount can be accomplished by one of ordinary skill in the art of making and using waterborne and solventborne coating compositions. However, several preferred combinations of acid catalyst type and acid catalyst amount which are useful in the process of the present invention, are as follows:

A. A phenyl acid phosphate, in an amount of from about 3 weight percent to about 5 weight percent, based on the weight of the solids in the solventborne clearcoat composition;

B. phenyl phosphonous acid in an amount of from about 3 weight percent to about 5 weight percent, based on the weight of solids in the solventborne clearcoat composition; and C. Nacure® 5543 (a brand of sulfonic acid available from King Industries of Norwalk, Conn.), in an amount of from about 1.5 weight percent to about 3 weight percent, based on the weight of solids in the solventborne clearcoat composition.

These preferred combinations of acid catalyst type and amount for use in the solventborne clearcoat composition have been found to be advantageous in carrying out the process of the present invention.

Once the waterborne basecoat composition and solventborne clearcoat composition are applied, the next step in the process is to simultaneously cure both the uncured basecoat layer as well as the uncured clearcoat layer. The curing step results in a crosslinking of, at a minimum, each of the coating layers (i.e. the organic resin and the crosslinker react to form a crosslinked matrix in the basecoat, and the organic polymer and the crosslinking resin react to form a crosslinked matrix in the clearcoat). However, the curing step generally (and preferably) further results in crosslinking the basecoat and the clearcoat to one another. The curing step crosslinks the organic resin, the crosslinking resin, and the polymer. The result of this crosslinking is the production of a cured coating. In general, the curing step is carried out at a high enough temperature and for a long enough time that the resulting coating has a desired degree of crosslinking. Preferably the curing step is carried out at a temperature of from about 240° F. to about 300° F., and for a time of from about 15 minutes to about 40 minutes. Still more preferably, the curing step is carried out at a temperature of from about 265° F. to about 300° F., and for a time of from about 15 minutes to about 30 minutes. Most preferably the curing step is carried out at a temperature of about 285° F., and for a time of about 20 minutes.

The basecoat and the clearcoat can be applied to the substrate by any conventional method in the art of coatings, such as brushing, spraying, dipping, flow coating, etc. Typically, spray application is used, especially for automotive coatings. Various types of spraying can be utilized such as compressed air spraying, electrostatic spraying, hot spraying techniques, airless spraying techniques, etc. These application techniques can be performed manually or by using specially designed automated application machines such as robotic systems.

Prior to the application of the coating materials of the present invention in automotive applications, or when dealing with ferrous substrates, a conventional corrosion-resistant primer is typically applied to the substrate. To this primed substrate is applied the basecoat composition. The primer coatings which can be used to coat substrates prior to carrying out the process of the present invention include cured cathodic electrocoat primers known in the art such as crosslinked amine-epoxy resin adducts such as those disclosed in U.S. Pat. Nos. 4,575,224 and 4,575,523, which patents are hereby incorporated by reference in their entireties. Other types of conventional primers include epoxies, acrylics, alkyds, polyurethanes, and polyesters applied by conventional methods such as spraying, brushing and the like. The applied primer coating is typically about 0.5 mil to about 1.0 mil thick. The basecoat is typically applied to a thickness of from about 0.4 mil to about 2.0 mils and preferably about 0.5 mil to about 1.0 mil. The basecoat thickness can be produced in a single coating pass or a plurality of passes with very brief drying ("flash") between applications of coats.

Once the basecoat has been applied, the substantially transparent clearcoat composition is applied after allowing the basecoat to flash at ambient temperatures for about 30 seconds to about 10 minutes, preferably about 1 to about 3 minutes. While the basecoat can be dried for longer periods of time, even at higher temperatures, a much improved product is produced by application of the solventborne clearcoat composition after only a brief flash. Some drying out of the basecoat layer is necessary to prevent total mixing of the basecoat layer and the clearcoat layer. However, a minimal degree of basecoat-clearcoat interaction (i.e. mixing) is desirable to achieve the best appearance of the coatings.

The clearcoat is preferably applied thicker than the basecoat (preferably about 1.8 to 2.3 mils) and can also be applied in a single or multiple pass.

Once the clearcoat composition is applied, the system is again flashed for 30 seconds to 10 minutes and the substrate together with both uncured coating layers thereon is thereafter baked at a temperature sufficient to drive off all of the solvent (in the instance of thermoplastic layers) or at a temperature sufficient to cure and crosslink (in the instance of thermosetting layers). Such temperatures can range from ambient temperature to about 400° F. Typically in the case of thermosetting materials, temperatures of about 265° F. are used, for example, for about 30 minutes. It should be appreciated by those skilled in the art that the process of the present invention can be carried out in any one or more of several conventional manners for the particular coating art employed, such as printing, non-automotive coating applications, container coating and the like. Coating thicknesses as well as drying and curing times and mechanisms will similarly vary within the coating art.

In the following examples, all parts listed are parts by weight based on the weight of the composition being discussed, unless specified otherwise.

EXAMPLE 1

A waterborne basecoat formulation was made by combining:

2.5 parts of water, 42.4 parts of a water dispersible polyurethane resin containing the reaction products of the following monomers:

| | |
|---|---|
| dimer fatty acid | 38.20% |
| isophthalic acid | 10.97% |
| 1,6-hexane diol | 20.38% |
| dimethylol propionic acid | 3.56% |
| neopentane glycol | 1.19% |
| isophorone diisocyanate | 20.13% |
| trimethylol propane | 3.21% |
| dimethyl ethanol amine | 2.36% |

5.2 parts of Cymel® 327 brand melamine resin (obtainable from American Cyanamid of Standard, Conn.), 17.5 parts of a pigment paste (37 percent solids), 0.5 parts of a Butyl Cellosolve® brand solvent (obtainable from Union Carbide of Danbury, Conn.), 0.1 parts of dimethyl ethanol amine (a free amine), 31 5 parts of a clay rheology control agent dispersion paste, and 0.4 parts of a triazole ultraviolet absorber.

These ingredients were then mixed thoroughly at room temperature, using an air driven motor mixer, the mixing being carried out for a period of at least 15 minutes. The total volume of the waterborne basecoat formulation was about 1 gallon.

A solventborne clearcoat formulation was made by combining:

4.86 parts of butanol, 2.09 parts of 2-ethylhexanol, 1.83 parts of methanol, 1.24 parts of xylene, 1.37 parts of Solvesso® 100 (obtained from Ashland Chemical, of Columbus, Ohio), 14.11 parts of a poly(hydroxypropyl methacrylate-co-n-butylacrylate-co-styrene-co-methacrylic acid) (39.0/35.3/23.5/2.2) (61.5% solids), 14.11 parts of poly(n-butylacrylate-co-hydroxypropyl methacrylate-co-butyl methacrylate-co-methyl methacrylate-co-methacrylic acid) (39.8/21.9/20.8/14.9/2.5) (75% solids), 28.23 parts of poly(hydroxyethyl methacrylate-co-isodecyl methacrylate-co-isobornyl methacrylate-co-methacrylic acid) (39/34/25/2) (61.5% solids), 56.45 parts of an acrylic resin (having an average percent solids of about 68%), 16.33 parts of a monomeric melamine resin (Resimene® 755, obtainable from Monsanto Chemical Co., of Springfield, Mass.), 2.81 parts of a polymeric melamine resin (Luwipal® 010, obtainable from BASF Aktiengesellschaft of Ludwigshafen, West Germany), 4.02 parts of additives (an acrylic flow aid, a silicone flow aid, an ultraviolet absorber, and a light stabilizer), and 9.00 parts of an amine-blocked phenyl acid phosphate acid catalyst (Nacure® XP-267 brand, obtainable from King Industries of Norwalk, Conn.).

These ingredients were then mixed thoroughly at room temperature with an air driven motor mixer, the mixing being carried out for a period of about 15 minutes. The total volume of the clearcoat formulation was about 1 gallon.

The viscosity of the resulting waterborne basecoat formulation was then reduced with 5:1 by weight of deionized water:butyl Cellosolve to 38 seconds on a #2° Fisher cup, and the basecoat formulation was then applied to a primed cold-rolled steel test panel via a syphon spray gun which atomized the basecoat formulation. The basecoat formulation was applied to achieve a cured film thickness of about 0.6 mil. The resulting coated steel panel was then placed in a 110° F. oven, and held therein for a period of about 3 minutes, whereby the coating was dried by flash evaporation.

The coated panel was then removed from the oven and the viscosity of the solventborne clearcoat formulation was then reduced to 48 seconds on a #4 Ford Cup by the addition of xylene, and then applied in a manner identical to the application of the waterborne basecoat formulation, except that the solventborne clearcoat formulation was applied in an amount to achieve cured thickness of about 1.6–2.0 mils.

The panel was then subjected to flash evaporation of the organic solvent by simply remaining at room temperature for about 7 minutes. Finally, curing of the coating was accomplished by placing the coated panel into an oven at 285° F. for a period of about 20 minutes. The resulting panel exhibited excellent physical properties, and had an appearance meeting automotive manufacturer's specifications.

A control panel was prepared with the identical procedure and same waterborne basecoat, but with a typical high solids clearcoat formulation containing the normal level of catalyst (about 0.5–1.0 weight percent active catalyst, based on the weight of solids in the clearcoat composition). The control panel exhibited severe clearcoat wrinkling and the appearance was not suitable for automotive use.

EXAMPLES 2–11

Experiments were run to evaluate catalyst types and levels to produce a wrinkle-free coating as in Example 1. In these experiments, all procedures and preparations were identical to Example except that the solventborne clearcoat formulation was changed by varying the acid catalyst types and levels. In the following table, all catalysts are listed as percent weight of active catalyst based on resin solids of the composition, unless specified otherwise. The solventborne clearcoat composition in Example 1 has 4% active phenyl acid phosphate relative to the resin solids.

Nacure ® 5543 is an amine blocked dodecylbenzene sulfonic acid from King Industries of Norwalk, Conn.

| Example | No. | Acid Catalyst(s) Used |
|---|---|---|
| 2 | | 0.5% phenyl acid phosphate 1% Nacure ® 5543 |
| 3 | 10 | 0.5% phenyl acid phosphate 2% Nacure ® 5543 |
| 4 | | 0.25% phenyl acid phosphate 1% Nacure ® 5543 |
| 5 | | 0.25% phenyl acid phosphate 2% Nacure ® 5543 |
| 6 | 20 | 0.12% phenyl acid phosphate 1% Nacure ® 5543 |
| 7 | 25 | 0.12% phenyl acid phosphate 2% Nacure ® 5543 |
| 8 | | 2% Nacure ® 5543 |
| 9 | 30 | 2% Nacure ® 4167 |
| 10 | | 2% Nacure ® 4167 1% Nacure ® 5543 |
| 11 | 35 | 6% Nacure ® 4167 |

In Examples 2 through 11, the test panels were prepared in a manner identical to Example 1. In each of Examples 2 through 11, the process produced a panel having excellent appearance results, with the exception of Examples 4 and 6, which characterized as exhibiting some wrinkling of the clearcoat. The coatings produced according to Examples 4 and 6 were considered unacceptable with respect to commercial standards for automotive body panel usage. The results of Examples 4 and 6, considered against the results of Examples 1–3, 5, and 7–11, demonstrate the advantageous effects resulting from using a higher than normal quantity of catalyst than is required for achieving a wrinkle-free appearance.

What is claimed is:

1. A process for producing a wrinkle-free coating, the process comprising the steps of:

A. applying a waterborne basecoat composition to a substrate so that an uncured basecoat layer is formed thereon, the waterborne basecoat composition comprising water, an organic resin, a crosslinker, and a free amine;

B. applying a substantially transparent solventborne clearcoat composition over the uncured basecoat layer so that an uncured clearcoat layer is formed over the uncured basecoat layer, wherein the solventborne clearcoat composition comprises:

i. an acid catalyst, ii. a monomeric melamine crosslinking resin, and iii. a polymer which is crosslinkable with melamine;

C. simultaneously curing both the uncured basecoat layer as well as the uncured clearcoat layer, whereby the organic resin, the crosslinker, the polymer, and the crosslinking resin are crosslinked, whereby a cured coating is produced; and wherein the acid catalyst is present in an amount of 1.5 weight percent to 5 weight percent so that a wrinkle-free coating is produced.

2. A process as described in claim 1 wherein the organic resin is present in the waterborne basecoat composition in an amount of from about 10 weight percent to about 70 weight percent, based on the weight of the waterborne basecoat composition.

3. A process as described in claim 1 wherein the crosslinking resin is present in the solventborne clearcoat composition in an amount of from about 10 weight percent to about 40 weight percent, based on the weight of the solventborne clearcoat composition.

4. A process as described in claim 1 wherein the polymer is present in the solventborne clearcoat composition in an amount of from about 10 weight percent to about 60 weight percent, based on the weight of the solventborne clearcoat composition.

5. A process as described in claim 1, wherein:

A. the organic resin is present in the basecoat composition in an amount of from about 10 weight percent to about 70 weight percent, based on the weight of the waterborne basecoat composition;

B. the crosslinking resin is present in the solventborne clearcoat composition in an amount of from about 10 weight percent to about 40 weight percent, based on the weight of the solventborne clearcoat composition; and C. the crosslinkable polymer is present in the solventborne clearcoat composition in an amount of from about 10 weight percent to about 60 weight percent, based on the weight of the solventborne clearcoat composition.

6. A process as described in claim 5, wherein the acid catalyst comprises at least one member selected from the group consisting of an acid anhydride, an acid phosphate, a mono sulfonic acid, a disulfonic acid, and an alkoxyacid.

7. A process as described in claim 6 wherein the acid catalyst is present in an amount of from 2 weight percent to 4 weight percent, based on the weight of solids in the solventborne clearcoat composition.

8. A process as described in claim 5 wherein the acid catalyst is selected from the group consisting of:

A. a phenyl acid phosphate, present at a level of from about 3 weight percent to about 5 weight percent, based on the weight of solids in the solventborne clearcoat composition;

B. a phenyl phosphonous acid, present at a level of from about 3 weight percent to about 5 weight percent, based on the weight of solids in the solventborne clearcoat composition; and C. a sulfonic acid, present at a level of from about 1.5 weight percent to about 3 weight percent, based on the weight of solids in the solventborne clearcoat composition.

9. A process as described in claim 7 wherein the waterborne basecoat composition comprises at least one member selected from the group consisting of an alkylamine, an alkanolamine, and ammonia, and wherein the crosslinker comprises at least one member selected from the group consisting of an aminoplast resin and an isocyanate resin.

10. A process as described in claim 5 wherein the waterborne basecoat composition comprises a dispersion of the organic resin in water.

11. A process as described in claim 10 wherein the free amine present in the waterborne basecoat composition comprises at least one member selected from the group consisting of a triethylamine, a dimethyl ethanol amine, and ammonia, and wherein the free amine is present in the basecoat composition in an amount of from about 0.3 weight percent to about 0.7 weight percent, based on the weight of the waterborne basecoat composition.

12. A process as described in claim 5, wherein:

A. the organic resin is present in the basecoat composition in an amount of from about 12 weight percent to about 25 weight percent, based on the weight of the waterborne basecoat composition;

B. the crosslinking resin is present in the solventborne clearcoat composition in an amount of from about 12 weight percent to about 22 weight percent, based on the weight of the solventborne clearcoat composition; and C. the crosslinkable polymer is present in the solventborne clearcoat composition in an amount of from about 30 weight percent to about 45 weight percent, based on the weight of the solventborne clearcoat composition.

13. A process as described in claim 12, wherein:

A. the organic resin is present in the basecoat composition in an amount of about 20 weight percent, based on the weight of the waterborne basecoat composition;

B. the crosslinking resin in the solventborne coating composition is present in an amount of about 18 weight percent, based on the weight of the solventborne clearcoat composition; and C. the crosslinkable polymer is present in the solventborne clearcoat composition in an amount of about 38 weight percent, based on the weight of the solventborne clearcoat composition.

14. A process as described in claim 12, wherein the free amine present in the waterborne basecoat composition is at least one member selected from the group consisting of an alkylamine and an alkanolamine, and wherein the free amine is present in the basecoat composition in an amount of from about 0.1 weight percent to about 1.5 weight percent, based on the weight of the waterborne basecoat composition.

15. A process as described in claim 5 wherein the curing is carried out by heating the uncured basecoat layer and the uncured clearcoat layer to a temperature of from about 240° F. to about 300° F., wherein the heating of the layers is performed for a period of from about 15 minutes to about 40 minutes.

16. A process as described in claim 12 wherein the curing is carried out by heating the uncured basecoat layer and the uncured clearcoat layer to a temperature of from about 265° F. to about 300° F., wherein the heating of the layers is performed for a period of from about 15 minutes to about 30 minutes.

17. A process as described in claim 13 wherein the free amine present in the waterborne basecoat composition is at least one member selected from the group consisting of a triethylamine and a diethyl ethanol amine, and wherein the free amine is present in the basecoat composition in an amount of about 0.04 weight percent, based on the weight of the waterborne basecoat composition.

18. A process as described in claim 17 wherein the curing is carried out by heating the uncured basecoat layer and the uncured clearcoat layer to a temperature of about 285 C, wherein the heating of the layers is performed for a period of about 20 minutes.

19. A process as described in claim 7 wherein the basecoat formulation comprises at least one pigment selected from the group consisting of organic pigments and metallic pigments.

20. A process as described in claim 19 wherein the pigment comprises an opaque pigment.

21. A process as described in claim 19 wherein the pigment comprises a metallic flake pigment.

22. A process as described in claim 19 wherein the pigment comprises at least one organic pigment and at least one metallic pigment, wherein at least one of the pigments is an opaque pigment.

23. A process as described in claim 7 wherein the substrate is an automotive body panel.

24. A process as described in claim 23 wherein the substrate is a metallic automotive body panel which has a primer coating thereon.

* * * * *